US008558784B2

(12) United States Patent
Kim

(10) Patent No.: US 8,558,784 B2
(45) Date of Patent: Oct. 15, 2013

(54) FLAT PANEL DISPLAY

(75) Inventor: Tae-Jin Kim, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 1299 days.

(21) Appl. No.: 11/381,644

(22) Filed: May 4, 2006

(65) Prior Publication Data

US 2006/0250349 A1 Nov. 9, 2006

(30) Foreign Application Priority Data

May 7, 2005 (KR) ..... 10-2005-0038204

(51) Int. Cl.
*G09G 3/34* (2006.01)

(52) U.S. Cl.
USPC ..... 345/107; 359/296

(58) Field of Classification Search
USPC ..... 345/107; 359/296
See application file for complete search history.

(56) References Cited

U.S. PATENT DOCUMENTS 7,177,066 B2 * 2/2007 Chung et al. ..... 359/296
2001/0046081 A1 * 11/2001 Hayashi et al. ..... 359/296
2002/0101433 A1 * 8/2002 McKnight ..... 345/589
2005/0212747 A1 * 9/2005 Amundson ..... 345/107
2006/0250348 A1 * 11/2006 Zhou et al. ..... 345/107

FOREIGN PATENT DOCUMENTS

JP 09-185087 A1 7/1997
WO WO 2005/006295 A1 * 1/2005

* cited by examiner

*Primary Examiner* — Jonathan Horner
(74) *Attorney, Agent, or Firm* — H.C. Park & Associates, PLC

(57) ABSTRACT

A flat panel display (FPD) with a reduced time required to change images between frames by improving waveforms of a selection signal and a drive signal. The FPD includes an electrode, an electrophoretic device with charged particles arranged in response to a data signal, and a transistor device controlling transmission of the data signal. An image frame includes a drive section in which the data signal is transmitted to the electrophoretic device to arrange the charged particles and display a grayscale image, and the data signal has a first pulse with a first voltage magnitude and a second pulse with a second voltage magnitude. The frame also includes a shake section for removing an image generated in a previous frame, and the selection signal transmitted to the transistor device during the shake section has a constant predetermined voltage and switches the transistor device on.

8 Claims, 5 Drawing Sheets

FLAT PANEL DISPLAY

CROSS REFERENCE TO RELATED APPLICATION

This application claims priority to and the benefit of Korean Patent Application No. 10-2005-0038204, filed on May 7, 2005, which is hereby incorporated by reference for all purposes as if fully set forth herein.

BACKGROUND OF THE INVENTION

1. Field of the Invention

The present invention relates to a flat panel display (FPD), and more particularly, to an FPD with a reduced time required to change images between frames by improving waveforms of a selection signal and a drive signal for driving the FPD.

2. Discussion of the Background

An electrophoretic display (EPD), a type of FPD, is a non-self light-emitting display that uses electrophoresis affecting charged particles suspended in a solvent to display an image.

Generally, an EPD includes a pair of opposing substrates which are separated from each other. The substrates each include an electrode, at least one of which is transparent. An electrophoretic device is interposed between the opposing substrates, and the electrophoretic device includes a dielectric solvent and charged particles dispersed in the dielectric solvent.

When different voltages are applied across the two electrodes, the charged particles move toward the electrode with polarity opposite to the polarity of the charged particles. The color of the image formed on the EPD is determined by the color of the dielectric solvent, the color of the charged particles, and the arrangement of the charged particles within the dielectric solvent.

The EPD transmits a selection signal and a data signal to pixels in a pixel region through scanning lines and data signal lines, respectively, to generate a predetermined grayscale image. A pixel is formed in the pixel region where a scanning line and a data signal line cross with each other in the pixel region. The data signal transmitted to each pixel can be controlled by a transistor device, which can be a thin film transistor (TFT).

FIG. 1 is a drive waveform for driving a conventional FPD.

To generate an image by controlling the arrangement of charged particles in an electrophoretic device, a frame includes a shake section, an image-loading section, and a bi-stable state section as illustrated in FIG. 1.

In the shake section, the charged particles are repeatedly and alternatingly moved between the two electrodes to remove an image generated in a previous frame.

The shake section is followed by the image-loading section, in which the charged particles are arranged to generate an image. The image-loading section includes a driver section, in which data is entered, and a pre-drive section occurring before the drive section.

In the pre-drive section, a data signal with the same magnitude and opposite polarity of the data signal in the drive section is transmitted to the pixel electrodes. Thus, a negative image is generated in the pre-drive section. This allows the grayscale image to be generated more accurately. Next, during the drive section, a data signal having predetermined grayscale information is transmitted to the pixel electrodes. As a result, a desired image is generated in the pixels of the EPD.

The image-loading section is followed by the bi-stable state section, in which the charged particles are stabilized and the arrangement of the charged particles within the dielectric solvent is maintained. Accordingly, the generated image is maintained for a predetermined period of time after the data is entered. In the bi-stable section, the selection signal and the data signal transmitted to the pixels are turned off, thereby reducing power consumption.

Generally, the selection signal transmitted to the pixels through the scanning lines S[1] through S[n] during the shake section and the image-loading section is a pulse signal having a predetermined positive voltage Vs and a predetermined negative voltage −Vs. To generate a desired image, the data signal Va and −Va transmitted to the pixels through the data signal lines D[1] through D[m] includes information regarding a desired arrangement of the charged particles in the electrophoretic cell. The information may be affected by the magnitude of the predetermined positive voltage and predetermined negative voltage.

Alternatively, an image may be generated by transmitting a signal having different pulse widths to the pixels using a pulse width modulation (PWM) method or by changing the number of pulses applied to the pixels during one frame.

However, according to a drive waveform for driving the conventional EPD, the selection signal is transmitted as an alternating pulse signal in the shake section. However, it is not necessary to selectively transmit the data signal to the pixels during the shake section. As a result, power consumption is increased unnecessarily.

In addition, the length of the shake section must last a predetermined duration to remove an image generated in a previous frame.

To generate an image, the pre-drive section and the drive section are required. However, when data is entered with a conventional drive waveform but without a pre-drive section, it is difficult to generate an accurate grayscale image. Therefore, the conventional EPD with a conventional drive waveform as illustrated in FIG. 1 requires time to change images in successive frames.

SUMMARY OF THE INVENTION

This invention provides an FPD with a reduced time required to change images between frames by improving waveforms of a selection signal and a drive signal for driving the FPD.

Additional features of the invention will be set forth in the description which follows, and in part will be apparent from the description, or may be learned by practice of the invention.

The present invention discloses a flat panel display including an electrode layer, an electrophoretic device comprising charged particles arranged to display a predetermined grayscale in response to a data signal transmitted to the electrophoretic device through the electrode layer during a drive section of a frame, and a transistor device controlling transmission of the data signal to the electrophoretic device. Further, the data signal has a first pulse with a first voltage magnitude and a second pulse with a second voltage magnitude corresponding to data information regarding the predetermined grayscale.

The present invention also discloses a flat panel display including an electrode layer, an electrophoretic device comprising charged particles arranged to display a predetermined grayscale in response to a data signal transmitted to the electrophoretic device through the electrode layer, and a transistor device controlling transmission of the data signal to the electrophoretic device in response to a selection signal. Further, a frame for generating an image comprises a shake section for removing an image generated in a previous frame, and the selection signal transmitted to a gate terminal of the transistor device during the shake section has a constant predetermined voltage and switches the transistor device on.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
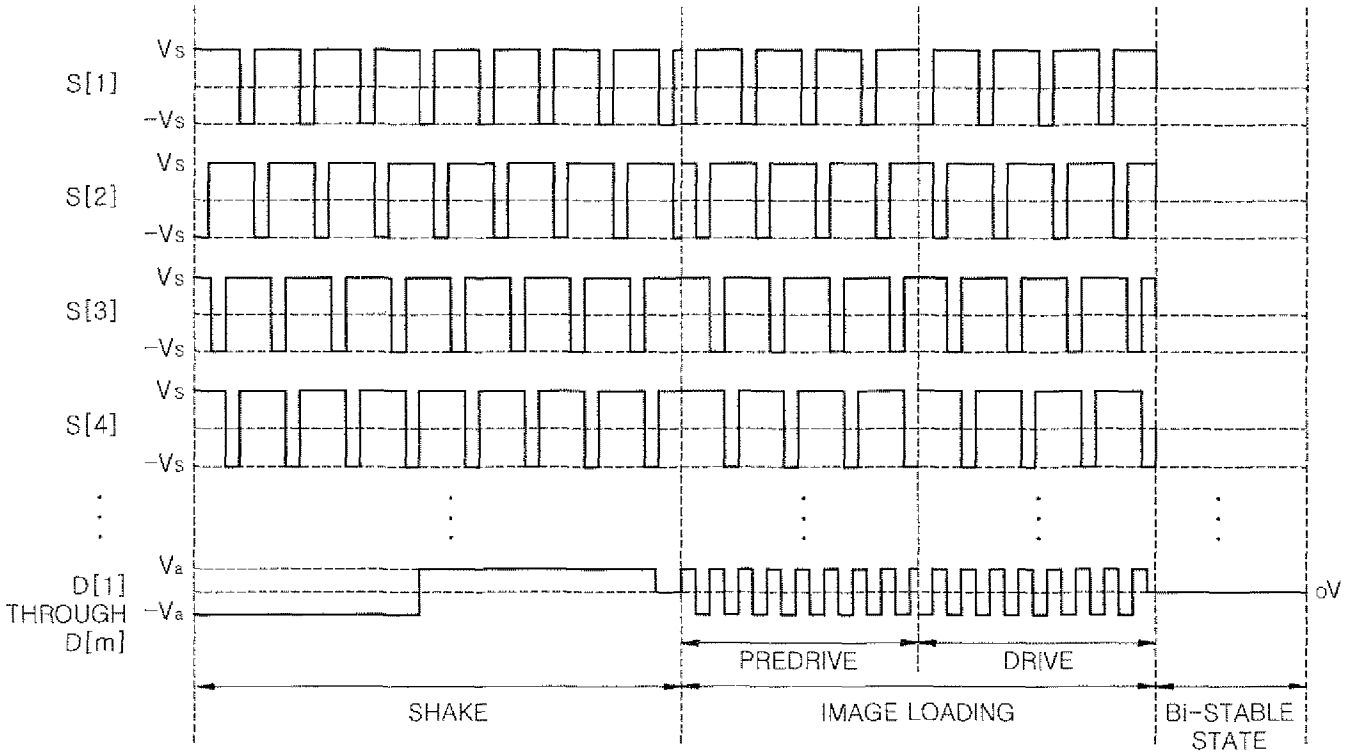
FIG. 1 (PRIOR ART)
FIG. 1 is a drive waveform for driving a conventional FPD.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
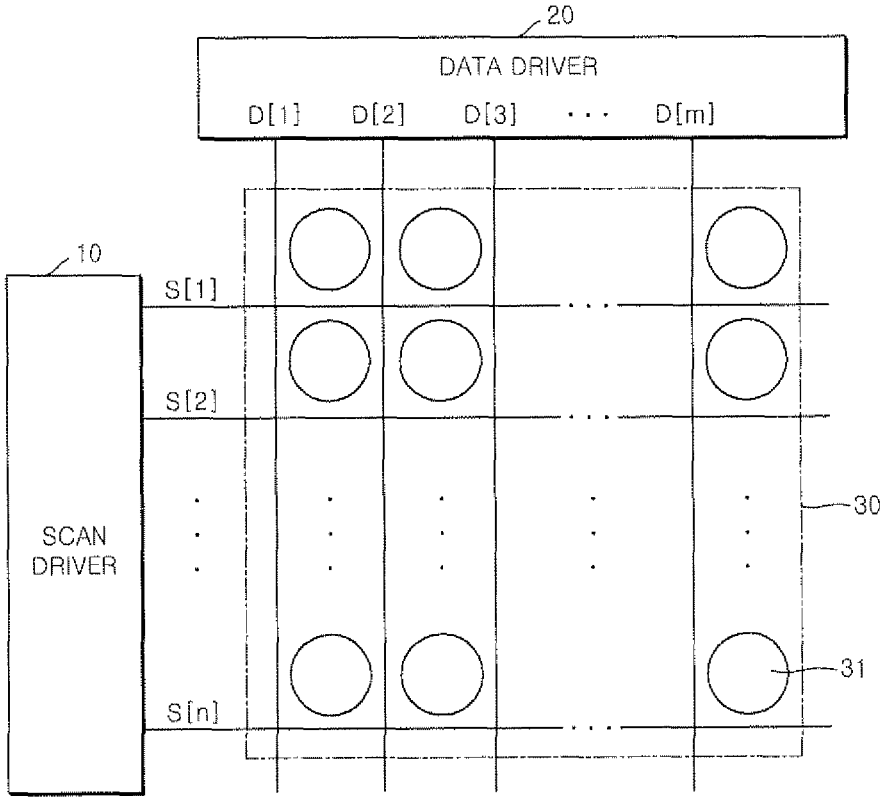
FIG. 2 is a schematic diagram of an FPD according to an exemplary embodiment of the present invention.

FIG. 2 is a schematic diagram of an FPD according to an exemplary embodiment of the present invention.

Referring to FIG. 2, the FPD includes a scan driver 10, a data driver 20, and a display panel 30. The FPD transmits first through $n^{th}$ selection signals S [1] through S [n] via a plurality of scanning lines, and first through $m^{th}$ data signals D [1] through D [m] via a plurality of data signal lines.

The scanning lines and the data signal lines cross with each other in the display panel 30, and a pixel 31 is defined where a scanning signal line and a data signal line cross with each other. In FIG. 2, n rows by m columns of pixels 31 are arranged in the display panel 30.

The scan driver 10 sequentially transmits the first through $n^{th}$ selection signals S [1] through S [n] to the pixels 31 through a plurality of selection signal lines and selects the pixels 31 by rows. The data driver 20 is synchronized with the first through $n^{th}$ selection signals S [1] through S [n] and transmits the first through $m^{th}$ data signals D [1] through D [m] to the pixels 31 through the data signal lines. Hence, a data signal with predetermined grayscale information can be transmitted to pixels selected from the pixels 31.

A pixel 31 can include a transistor device for selectively inputting data to the pixel 31 in response to a selection signal S [n] and a data signals D [m]. A pixel 31 can also include an electrophoretic device for generating a predetermined grayscale image based on the data signal, which will be described now with reference to FIG. 3.

Figure 3:
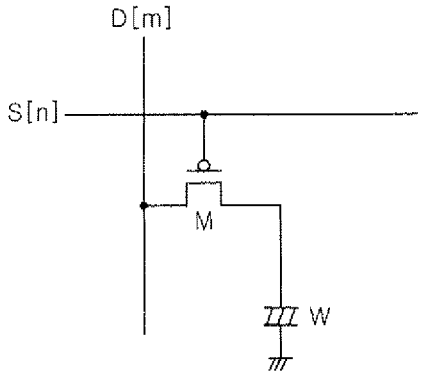
FIG. 3 is a pixel circuit diagram for an FPD according to an exemplary embodiment of the present invention.

FIG. 3 is a pixel circuit diagram for an FPD according to an exemplary embodiment of the present invention. Specifically, FIG. 3 is a pixel circuit diagram for a pixel 31 in an EPD.

Referring to FIG. 3, the pixel circuit includes an $n^{th}$ scanning line and an $m^{th}$ data signal line, which cross approximately perpendicular with each other. The $n^{th}$ scanning line transmits a selection signal S [n] and the $m^{th}$ data line transmits data signal D [m].

The pixel circuit can further include a transistor device M which can be turned on or off in response to the $n^{th}$ selection signal S [n] since the selection signal line is coupled with the gate terminal of the transistor device M. The transistor device M allows the $m^{th}$ data signal D [m] to be transmitted to the pixel 31 through the data signal line. The transistor device M may be a TFT.

The transistor device M illustrated in FIG. 3 is a PMOS transistor device. The transistor device M is turned on when the $n^{th}$ selection signal S [n] has a negative voltage. Hence, the $m^{th}$ data signal D [m] can be transmitted to the pixel 31 when the $n^{th}$ selection signal S[n] has a negative voltage. The transistor device M may be a different device that performs the same or substantially similar operation as described.

When the FPD is an EPD, the pixel circuit further includes an electrophoretic device W. A first end of the electrophoretic device W can be electrically coupled with a drain electrode of the transistor device M. Hence, when the transistor device M is turned on, the $m^{th}$ data signal D [m] is transmitted to the electrophoretic device W.

A second end of the electrophoretic device W can be electrically coupled with a predetermined electrode. As shown on the pixel circuit of FIG. 3, the second end of the electrophoretic device W can be coupled with ground.

Accordingly, voltage of the $m^{th}$ data signal D [m] is applied to a first end of the electrophoretic device W, and a ground voltage is applied to a second end of the electrophoretic device W. Charged particles within the electrophoretic device W are moved by a voltage difference across the ends of the electrophoretic device W and arranged accordingly. In a bistable state section after data writing is completed, the arrangement of the charged particles is maintained. As a result, a predetermined grayscale image is generated.

To describe a method of generating an image using the movement of the charged particles, the structure of the electrophoretic device W will now be described in detail with reference to FIG. 4.

Figure 4:
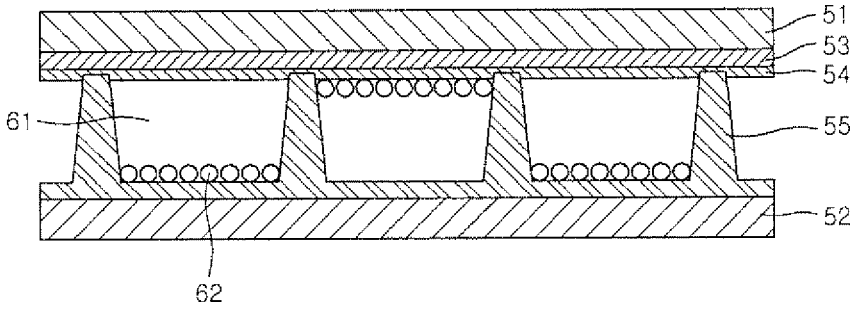
FIG. 4 is a detailed cross-sectional view of an electrophoretic device according to an exemplary embodiment of the present invention.

FIG. 4 is a detailed cross-sectional view of an electrophoretic device according to an exemplary embodiment of the present invention.

Referring to FIG. 4, the electrophoretic device W includes an upper electrode layer 51 on an upper substrate (not shown), and a lower electrode layer 52 on a lower substrate (not shown).

The present invention further includes an adhesive layer 53 for bonding the upper substrate and lower substrate, and a sealing layer 54 arranged between the upper substrate and lower substrate.

Barrier ribs 55 are formed on a surface of the lower electrode layer 52 facing the upper electrode layer 51. Micro-cups are arranged in the spaces between the upper substrate and lower substrate, and defined by the barrier ribs 55. Each micro-cup is filled with a dielectric solvent 61. Depending on image-generating characteristics of the electrophoretic device W, the dielectric solvent 61 may be a predetermined color, such as red, green, or blue.

Charged particles 62 are dispersed in the dielectric solvent 61. The charged particles 62 may have a positive polarity or negative polarity. To achieve a full-color display, the charged particles 62 may be white, and an FPD background may be black.

In the case of a monochromatic display which displays a black and white grayscale image, the micro-cups of the electrophoretic device W may be filled with a dielectric solvent 61 of one color, white or black, and the charged particles 62 of the other color may be dispersed in the dielectric solvent 61. In addition, a white or black background color can be used.

When the electrophoretic device W of FIG. 4 is used in a monochromatic display that displays an image in black and white, the charged particles 62 can be white and dispersed in a black dielectric solvent 61 within the micro-cups. A predetermined voltage is applied to the upper electrode layer 51 in response to a data signal when a selection signal turns transistor device M on.

The lower electrode layer 52 may be electrically coupled with a voltage source which applies a predetermined voltage, or a ground voltage may be applied to the lower electrode layer 52.

The charged particles 62 may have a positive or negative polarity. The charged particles 62 vertically move in response to an electric field created by a voltage difference between the upper electrode layer 51 and the lower electrode layer 52.

For example, white charged particles 62 with a positive polarity in a black dielectric solvent 61 will move toward the lower electrode layer 52 and arrange accordingly when a data signal having a large positive voltage is transmitted to the upper electrode layer 51. The voltage difference between the upper electrode layer 51 and the lower electrode layer 52 determines the distance by which the charged particles 62 move toward the lower electrode layer 52. The greater the positive voltage applied to the upper electrode layer 51, the closer to the lower electrode layer 52 the charged particles 62 move. More dielectric solvent 61, which can be black, is located proximate to the upper electrode layer 51. Accordingly, the electrophoretic device W generates a color closer to black than white. A user can view the color through a substrate and a transparent electrode layer.

Conversely, if a data signal with a large negative voltage is transmitted to the upper electrode layer 51, the positive polarity charged particles 62 move toward the upper electrode layer 51 and are arranged accordingly. Since the charged particles 62 are white, the electrophoretic device W generates a color close to white than to black. Moreover, as the negative voltage applied to the upper electrode layer 51 increases, the quantity of charged particles 62 that move toward the upper electrode layer 51 and are arranged accordingly also increases. Thus, as the negative voltage applied to the upper electrode layer 51 increases, the color generated by the electrophoretic device W is a grayscale close to white.

Moreover, the voltage of the data signal applied to the upper electrode layer 51 can be controlled. By controlling the voltage, charged particles 62 other than those which move toward the upper electrode layer 51 and lower electrode layer 52 can be dispersed in the dielectric solvent 61 and arranged in the middle of the micro-cup. A gray image of a desired degree between white and black can be generated. Thus, with an electrophoretic device W as described, a desired grayscale can be generated by transmitting a data signal with a predetermined voltage corresponding to a color according to the desired grayscale.

The FPD having the pixel circuit and the cell structure as described above is an exemplary embodiment of the present invention. Drivers for driving the FPD and a circuit device for controlling the color realization of the electrophoretic device W may vary to generate the colors as described above.

The electrophoretic device W included in the EPD, which has been described with reference to FIG. 4, is a micro-cup type electrophoretic device. However, the present invention is not limited thereto. Various types of electrophoretic devices may be applied to the present invention. Further, the electrophoretic device W may include an in-plane type electrode which moves and arranges the charged particles 62 horizontally in addition to a vertical electrode which moves the charged particles 62 vertically.

The operation of the FPD structured as described above will now be described with reference to drive waveforms of FIG. 5 and FIG. 6.

Figure 5:
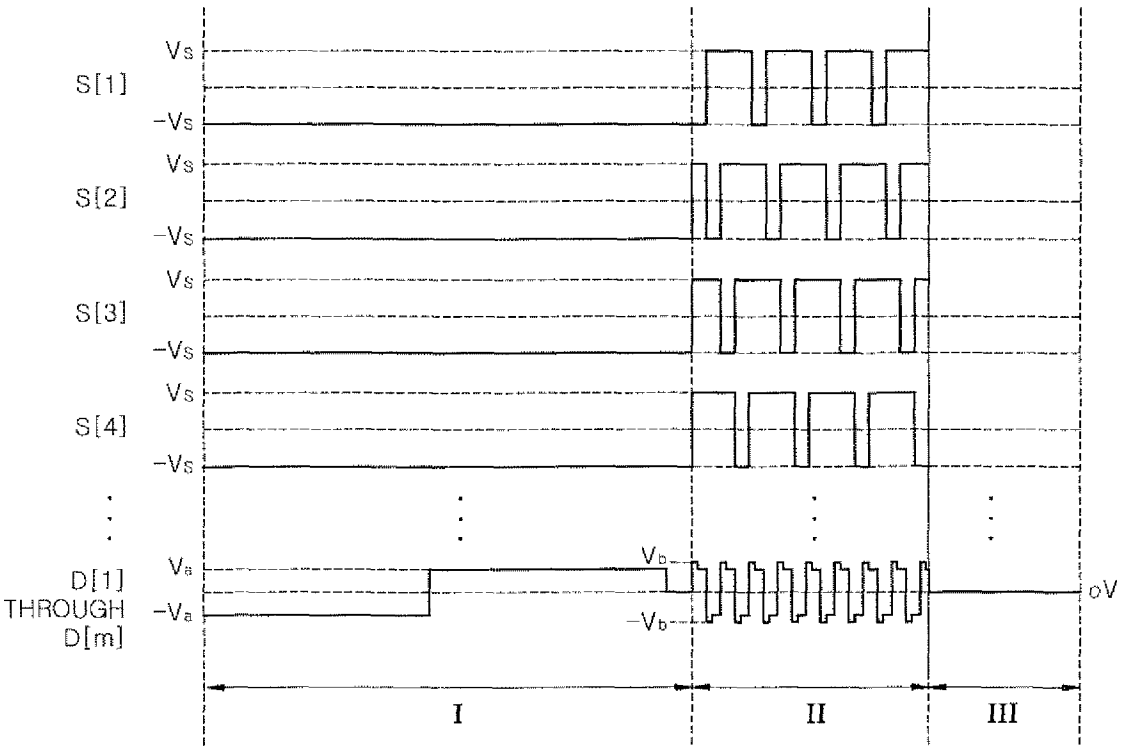
FIG. 5 is a drive waveform for driving an FPD according to an exemplary embodiment of the present invention.

FIG. 5 is a drive waveform for driving an FPD according to an exemplary embodiment of the present invention. FIG. 6 is a detailed waveform of a data signal transmitted during a drive section according to an exemplary embodiment of the present invention.

Referring to FIG. 5, a frame for generating an image can include a shake section I, a drive section II, during which an image is loaded, and a Bi-stable state section III. The scan driver 10 and the data driver 20 can control a drive waveform applied during each section.

In the shake section I, the charged particles 62 are repeatedly moved toward one of the two electrode layers within the micro-cups to remove an image generated in a previous frame.

Therefore, the first through $n^{th}$ selection signals S [1] through S [n] are transmitted to rows of pixels 31 through the scan lines in the shake section I. As shown in FIG. 5, the first through $n^{th}$ selection signals S [1] through S [n] may have a predetermined voltage $-V_s$ to switch the transistor devices M on, thereby allowing an $m^{th}$ data signal D [m] to be transmitted to a gate electrode of a transistor device M in a pixel circuit of a pixel 31.

Accordingly, without repeatedly switching the pixels 31 on and off, the image generated in a previous frame can be removed from all of the pixels 31. Since the first through $n^{th}$ selection signals S [1] through S [n] are transmitted to the pixels 31 with a predetermined voltage $-V_s$ instead of a pulse signal having alternating pulses of predetermined positive and negative voltages, power consumption during the shake section I can be reduced. In addition, since the transistor devices M can remain switched on, the required length of the shake section I can be reduced.

In the shake section I, the first through $m^{th}$ data signals D [1] through D [m] are transmitted with positive voltage $V_a$ in the first portion of the shake section I and negative voltage $-V_a$ in the second portion of the shake section I. Accordingly, the charged particles 62 are vertically shaken and mixed in the micro-cups. Additionally, the invention is not limited hereto. For example, the first through $m^{th}$ data signals D [1] through D [m] can be transmitted with positive voltage $V_a$ in the second portion of the shake section I and negative voltage $-V_a$ in the first portion of the shake section I.

The shake section I is followed by the drive section II, in which the charged particles 62 are arranged to generate a predetermined grayscale image. In the drive section II, the first through $n^{th}$ pulse-type selection signals S [1] through S [n] with alternating positive voltage $V_s$ and negative voltage $-V_s$ are sequentially transmitted to the pixels 31 through the scan lines to select the pixels 31 by rows.

Furthermore, the first through $m^{th}$ data signals D [1] through D [m], which are synchronized with the first through $n^{th}$ selection signals S [1] through S [n], are transmitted to one of the electrodes of the electrophoretic devices W in pixels 31. The first through $m^{th}$ data signals D [1] through D [m] include information required to generate a predetermined grayscale image in each pixel 31.

In particular, an $m^{th}$ data signal D [m], transmitted during the drive section II, has at least two voltages corresponding to information regarding a grayscale. A first pulse with voltage $V_b$ can be for increasing the movement of the charged particles 62 and a second pulse with voltage $V_a$ can be for arranging the charged particles 62 to generate a predetermined grayscale image.

An absolute value of the first pulse voltage $V_b$ can be greater than the absolute value of the second pulse voltage $V_a$. Accordingly, when the first pulse voltage $V_b$ is applied to an electrode of an electrophoretic device W, the resulting electric field has an increased magnitude. Thus, movement of the charged particles 62 increases toward an electrode layer with a polarity opposite to the polarity of the charged particles 62.

After a signal with the second pulse voltage $V_a$ is transmitted to the pixels 31, the charge particles 62 are arranged to generate a predetermined grayscale image. In FIG. 5, the first pulse voltage $V_b$ for increasing the movement of the charged particles 62 has positive and negative polarity values of $V_b$ and $-V_b$, and the second pulse voltage $V_a$ for generating an image has positive and negative polarity values of $V_a$ and $-V_a$. However, this is merely an embodiment of the present invention. The magnitude of the first pulse voltage and second pulse voltage may vary depending on the predetermined image to be displayed.

Figure 6:
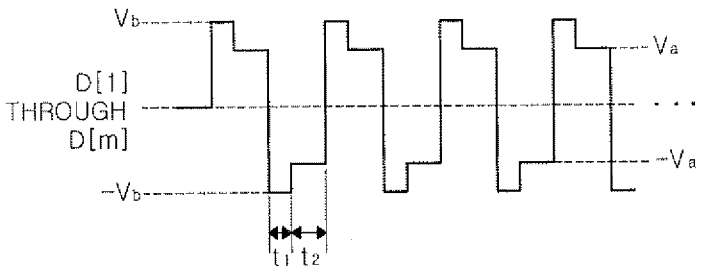
FIG. 6 is a detailed waveform of a data signal transmitted during a drive section according to an exemplary embodiment of the present invention.

Referring to FIG. 6, a section in which a data signal with the first pulse voltage $V_b$ is transmitted can be a first section with duration t1, and a section in which a data signal with the second pulse voltage $V_a$ is transmitted can be a second section with duration t2. The total time (t1+t2) required to transmit the first through $m^{th}$ data signals D [1] through D [m] to generate a predetermined grayscale image can therefore be reduced. That is because the initial movement of the charged particles 62 can be significantly increased by applying an electric field with increased magnitude compared to the conventional art. To generate a stable predetermined grayscale image, the duration of the second section t2 may be longer than the duration of the first section t1.

Using the improved data signals as described above, the movement of the charged particles 62 can be increased and the charged particles 62 can be quickly arranged. Therefore, the time required to change images between frames can be reduced. Moreover, the pre-drive section which was previously included in a frame to enter data can be omitted without significantly reducing image quality. Therefore, the time required to change images between frames can be reduced further.

The drive section II is followed by the bi-stable state section III, in which the charged particles 62 are stabilized and the arrangement of the charged particles 62 within the dielectric solvent 61 is maintained. Accordingly, the image that is to be generated is maintained for a predetermined period of time after the data is entered. In the bi-stable section III, the first through $n^{th}$ selection signals S [1] through S [n] and the first through $m^{th}$ data signals D [1] through D [m] are turned off or transmitted to the pixels 31 as 0 voltage signals, thereby reducing power consumption.

The transistor device M included in the FPD according to the present invention can be an organic thin film transistor (OTFT), which possesses superior moldability, flexibility, and low manufacturing costs.

As described above, an FPD according to the present invention improves waveforms of a data signal and a selection signal for operating the panel. Therefore, power consumed to drive the panel can be decreased, and the time required to change images between frames can be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A flat panel display, comprising:

an electrode layer;

an electrophoretic device comprising charged particles arranged to display a predetermined grayscale in response to a data signal transmitted to the electrophoretic device through the electrode layer during a drive section of a frame; and a transistor device to control transmission of the data signal to the electrophoretic device, wherein the data signal has a first pulse with a first voltage magnitude corresponding to data information regarding the predetermined grayscale and a second pulse with a second voltage magnitude corresponding to data information regarding the predetermined grayscale, a duration of the first pulse being shorter than a duration of the second pulse, wherein the first pulse is applied before the second pulse, wherein the first pulse and the second pulse both have alternating polarities, wherein the first pulse and the second pulse having the same polarity are consecutively applied, and wherein the first voltage magnitude is greater than the second voltage magnitude.

2. The flat panel display of claim 1, wherein the frame further comprises:

a shake section before the drive section, the shake section for removing an image generated in a previous frame; and a bi-stable state section after the drive section, the bi-stable state section for stabilizing and maintaining the arrangement of the charged particles.

3. The flat panel display of claim 2, wherein a selection signal transmitted to a gate terminal of the transistor device during the shake section has a constant predetermined voltage and switches the transistor device on.

4. The flat panel display of claim 1, wherein the first pulse increases movement of the charged particles and the second pulse arranges the charged particles to generate the predetermined grayscale.

5. The flat panel display of claim 1, wherein the charged particles are dispersed in a dielectric solvent.

6. The flat panel display of claim 5, wherein a color of the charged particles is different than a color of the dielectric solvent.

7. The flat panel display of claim 1, wherein the transistor device is an organic thin film transistor.

8. The flat panel display of claim 1, wherein the flat panel display is an electrophoretic display.

* * * * *